US010321248B2

(12) United States Patent
Thaysen

(10) Patent No.: US 10,321,248 B2
(45) Date of Patent: Jun. 11, 2019

(54) HEARING DEVICE SHELL WITH GUIDE STRUCTURE

(71) Applicant: GN Hearing A/S, Ballerup (DK)

(72) Inventor: Jesper Thaysen, Skovlunde (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/731,169

(22) Filed: Jun. 4, 2015

(65) Prior Publication Data

US 2016/0360329 A1 Dec. 8, 2016

(30) Foreign Application Priority Data

Jun. 3, 2015 (DK) ..... 2015 70338
Jun. 3, 2015 (EP) ..... 15170402

(51) Int. Cl.
*H04R 25/00* (2006.01)

(52) U.S. Cl.
CPC ..... *H04R 25/65* (2013.01); *H04R 25/554* (2013.01); *H04R 25/652* (2013.01); *H04R 2225/51* (2013.01)

(58) Field of Classification Search
CPC .... H04R 25/65; H04R 25/554; H04R 25/652; H04R 2225/51
USPC ..... 381/322, 324, 330
See application file for complete search history.

(56) References Cited

U.S. PATENT DOCUMENTS

2005/0168396 A1 8/2005 Victorian et al.
2005/0244024 A1 11/2005 Fisher et al.
2007/0086610 A1* 4/2007 Niederdrank ..... H01Q 1/273 381/312
2009/0046879 A1 2/2009 Knudsen et al.
2010/0158291 A1 6/2010 Polinske et al.
2010/0158295 A1* 6/2010 Polinske ..... H01Q 1/243 381/323
2011/0051966 A1* 3/2011 De Finis ..... H04R 25/65 381/322
2011/0142270 A1 6/2011 Niederdrank
(Continued)

FOREIGN PATENT DOCUMENTS

EP 2 680 613 A2 1/2014
EP 2680366 A1 1/2014
(Continued)

OTHER PUBLICATIONS

First Technical Examination and Search Report dated Jan. 7, 2016 for corresponding Danish Patent Application No. PA 2015 70338, 8 pages.
(Continued)

*Primary Examiner* — Yogeshkumar Patel
(74) *Attorney, Agent, or Firm* — Vista IP Law Group, LLP

(57) ABSTRACT

A shell for a hearing device, includes: a shell body having an inner surface, the shell body extending from a first end to a second end, the shell body comprising a rim defining an opening at the second end, the rim defining a rim plane, the shell comprising a guide structure at the inner surface for guiding an antenna, wherein the guide structure comprises a first guide member at the inner surface, wherein at least a part of the first guide member extends along the inner surface at an angle that is anywhere from 45 degrees to 135 degrees with respect to a normal of the rim plane.

29 Claims, 11 Drawing Sheets

(56) References Cited

U.S. PATENT DOCUMENTS

| | | | | |
|---|---|---|---|---|
| 2013/0343586 | A1* | 12/2013 | Kvist | H04R 25/554 381/315 |
| 2014/0023216 | A1* | 1/2014 | Solum | H04R 25/554 381/315 |
| 2015/0146900 | A1 | 5/2015 | Vonlanthen et al. | |

FOREIGN PATENT DOCUMENTS

| | | | |
|---|---|---|---|
| EP | 2688314 | A2 | 1/2014 |
| EP | 2688314 | A3 | 2/2014 |

OTHER PUBLICATIONS

Extended European Search Report for EP Patent Application No. 15170402.0 dated Nov. 4, 2015 (7 pages).

* cited by examiner

HEARING DEVICE SHELL WITH GUIDE STRUCTURE

RELATED APPLICATION DATA

This application claims priority to and the benefit of Danish Patent Application No. PA 2015 70338, filed on Jun. 3, 2015, pending, and European Patent Application No. 15170402.0, filed on Jun. 3, 2015, pending. The entire disclosures of both of the above applications are expressly incorporated by reference herein.

FIELD

The present disclosure relates to a shell for a hearing device, to a hearing device comprising a shell and a related method for manufacturing the shell, and in particular to a shell for a hearing device providing a guide structure for guiding an antenna on the inner surface of the shell.

BACKGROUND

Hearing devices capable of using wireless technology are well-known. The strict size requirements, in particular for an In-The-Ear hearing devices, and the position and size of antennas have been and are still a challenge to the hearing device developers.

SUMMARY

Despite the developments, there is still a need to provide hearing devices that are easy to manufacture, and at the same time having satisfactory transmission/reception properties when the hearing device is positioned in the ear.

Further, there is a need for improving the wireless performance between a hearing device and another device, for example a remote control for the hearing device, and for improving the battery life of the hearing device. This is obtained by the present shell, hearing device and method.

Disclosed is a shell for a hearing device. The shell comprises a shell body having an inner surface. The shell body extends from a first end to a second end, and the shell body comprises a rim defining an opening at the second end. The shell comprises a guide structure on the inner surface for guiding an antenna, wherein the guide structure comprises at least one guide member including a first guide member in the inner surface. At least a part of the first guide member may extend along the inner surface substantially at an angle in a range between 45 degrees and 135 degrees to a rim plane normal. Alternatively and/or the first guide member may at least partially define an antenna space having a plane that forms an angle anywhere from 45° to 135° with respect to a normal of the rim plane.

Also disclosed is a hearing device comprising a shell. The hearing device comprises an antenna extending at least partly within a guide member of the shell. The shell comprises a shell body having an inner surface. The shell body extends from a first end to a second end, and the shell body comprises a rim defining an opening at the second end. The shell comprises a guide structure on the inner surface for guiding the antenna, wherein the guide structure comprises at least one guide member including a first guide member in the inner surface. At least a part of the first guide member may extend along the inner surface substantially at an angle in a range between 45 degrees and 135 degrees to a rim plane normal. Alternatively and/or the first guide member may at least partially define an antenna space having a plane that forms an angle anywhere from 45° to 135° with respect to a normal of the rim plane.

Also disclosed is a method for manufacturing a shell for a hearing device. The method comprises forming a shell body having an inner surface, wherein forming the shell body comprises forming a guide structure on the inner surface. The guide structure comprises at least one guide member including a first guide member in the inner surface. The shell body extends from a first end to a second end, and the shell body comprises a rim defining an opening at the second end. The guide structure may be for guiding an antenna. At least a part of the first guide member may extend along the inner surface substantially at an angle in a range between 45 degrees and 135 degrees to a rim plane normal. Alternatively and/or the first guide member may at least partially define an antenna space having a plane that forms an angle anywhere from 45° to 135° with respect to a normal of the rim plane.

It is an advantage that the shell, hearing device and method as disclosed above provides a well-defined antenna configuration and position in the shell of the hearing device, whereby the wireless performance between the hearing device, by means of the antenna, and another device, such as a remote control for the hearing device can be improved, as this will improve the hearing device functionality in general, for example making it easier to program software for the hearing device, and improve the battery lifetime of the hearing device.

Further, the guide structure may contribute to more easy and simple manufacture and/or assembly of the hearing device.

A shell for a hearing device, includes: a shell body having an inner surface, the shell body extending from a first end to a second end, the shell body comprising a rim defining an opening at the second end, the rim defining a rim plane, the shell comprising a guide structure at the inner surface for guiding an antenna, wherein the guide structure comprises a first guide member at the inner surface, wherein at least a part of the first guide member extends along the inner surface at an angle that is anywhere from 45 degrees to 135 degrees with respect to a normal of the rim plane.

Optionally, the guide structure extends parallel to the rim plane.

Optionally, the first guide member comprises a part of the inner surface that defines a first recess.

Optionally, the shell body comprises an inwardly extending portion at the second end, wherein the first recess is formed at the inwardly extending portion.

Optionally, a distance between the first recess and the second end is at least 5 mm.

Optionally, the first recess is at least partly helical.

Optionally, the guide structure further includes a second guide member at the inner surface.

Optionally, the second guide member and the first guide member are arranged with a distance therebetween along an axis parallel to the rim plane.

Optionally, the first guide member defines a first recess, wherein the second guide member defines a second recess, and wherein the second recess and the first recess are arranged with a distance to each other along an axis perpendicular to the rim plane.

Optionally, the first guide member defines a first recess, wherein the second guide member defines a second recess extending along the inner surface at an angle larger than 45 degrees to the normal of the rim plane, and wherein the second recess and the first recess are arranged with a distance to each other.

Optionally, the first guide member comprises a first set of protrusions extending along the inner surface.

Optionally, the first guide member comprises an inwardly extending part of the inner surface.

Optionally, the shell body comprises a contact surface configured for attaching a faceplate to the shell.

A hearing device includes the shell, wherein the hearing device comprises an antenna that is at least partially guided by the first guide member.

A method for manufacturing a shell for a hearing device, includes: forming a shell body having an inner surface and a guide structure at the inner surface, wherein the guide structure comprises a first guide member at the inner surface; wherein the shell body extends from a first end to a second end, the shell body comprising a rim defining an opening at the second end, the rim defining a rim plane, wherein the guide structure is for guiding an antenna, and wherein at least a part of the first guide member extends along the inner surface at an angle that is anywhere from 45 degrees to 135 degrees with respect to a normal of the rim plane.

Other aspects, embodiments, and/or advantageous will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
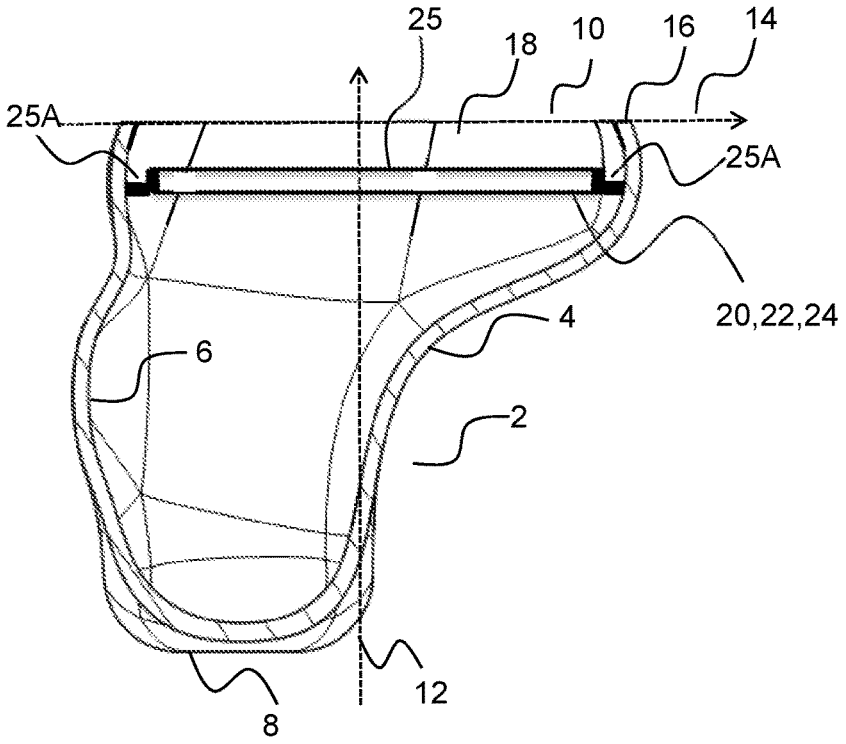
FIG. 1 schematically illustrates an exemplary shell,
FIG. 2*a* schematically illustrates an exemplary shell,
FIG. 2*b* schematically illustrates an exemplary shell,
FIG. 3*a* schematically illustrates an exemplary shell,
FIG. 3*b* schematically illustrates an exemplary shell,
FIG. 3*c* schematically illustrates an exemplary shell,
FIG. 4 schematically illustrates an exemplary shell,
FIG. 5 schematically illustrates an exemplary shell,
FIG. 6 schematically illustrates an exemplary shell,
FIG. 7 schematically illustrates an exemplary shell,
FIG. 8 schematically illustrates an exemplary shell.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

The shell for a hearing device may be for example an in-the-ear (ITE) shell for an ITE hearing device. Thus, the shell may be configured to be at least partly positioned in the ear canal of a user. The hearing device may be a hearing aid, and for example a processing unit of the hearing device may be configured for hearing loss compensation of a user's hearing loss.

The shell comprises a shell body having an inner surface, where the shell body may be a wall of the shell.

The shell body extends from a first end to a second end along an axis perpendicular to a rim plane. Thus the first end may be configured to point towards the tympanic membrane, the inner ear, the head of the user, when the hearing device shell is arranged in the user's ear. The second end may be an open end of the shell which is configured to be closed by and fastened to a faceplate, e.g. by gluing, welding, mechanical fastening elements and/or other suitable fasteners. The second end may be configured to point towards the opening of the ear to the surroundings, when the hearing device shell is arranged in the user's ear.

The shell body comprises a rim defining an opening of the shell at the second end. The opening facilitates insertion of hearing device components, such as receiver, microphone, antenna and processing unit in the shell. The rim may extend or substantially extend along a rim plane. The rim plane may be the plane of the shell body where the faceplate of the hearing device is configured to be attached to the rim defining the opening of the shell at the second end.

As used in this specification, the term "substantially" refer to a variation that is less than 10%. For example, two items that are substantially parallel may refer to a first item that forms a 180°±18° relative to the second item.

The shell comprises a guide structure for guiding an antenna on the inner surface of the shell body. The guide structure comprises at least one guide member including a first guide member in the inner surface. The guide structure may comprise a plurality of guide members including the first guide member and a second guide member in the inner surface. A guide member may take the form of an extension member, flange, helical structure, recesses, protrusion, canal, rib, ridge, bump or support structure arranged for guiding an antenna within the shell. The guide structure may facilitate press fitting of the antenna or at least parts thereof against the inner surface of the shell body.

The guide structure and/or at least the first guide member may be arranged close to the rim of the shell, e.g. within 3 mm from the rim of the shell. The first guide member may be arranged in the half of the shell closest to the second end of the shell, or in the quarter of the shell closest to the second end, or in the third of the shell closest to the second end. Thereby, an antenna of the hearing device when mounted in the shell is supported in a position facilitating wireless transmission/reception.

The shell may be custom made to the user, so that the shell fits the ear canal of the user. The shell can be made by providing a 3D surface scan of the user's ear canal, either by scanning directly in the ear canal of the user or by scanning an ear mould replicating the shape of the ear canal.

The antenna may be a 2.4 GHz antenna complying with the IEEE800.11 specifications which is a standard for wireless local area network (WLAN) computer communication in for example the 2.4 GHz frequency bands.

The antenna may be an electrical antenna. The antenna may be a resonant antenna. The resonant antenna may have a length of one quarter or one half wavelength so that a standing wave structure can be accommodated. A quarter wavelength corresponds to about 25-35 mm, such as about 30 mm. A half wavelength corresponds to about 50-70 mm, such as about 55 mm or 60 mm. The actual physical length depends on the material surrounding the antenna, which in this case would be the material of the shell, which is typically a thin, hard plastic material. The antenna may be a monopole antenna. The antenna may be a dipole antenna.

The thickness of the shell may be about 0.1-30 mm.

In prior art manufacturing of the shell for the hearing device, the person or operative assembling the shell and the hearing device would not fix the antenna in the shell but just place it randomly in the shell. According to the present shell, hearing device and method for manufacturing the shell and hearing device, the antenna will be fixed or attached or guided in the at least one guide member of the guide structure in the inner surface of the shell body of the shell.

A center point of the closed curve defining the opening of the rim at the second end of the shell may be defined. A center axis perpendicular to the rim plane through this center point may be defined.

The guide structure comprises at least one guide member including a first guide member in the inner surface. At least a part of the first guide member may extend along the inner surface at an angle or substantially at an angle in a range between 45 degrees and 135 degrees to a rim plane normal. At least a part of the first guide member may extend along the inner surface at an angle or substantially at an angle larger than 45 degrees to a rim plane normal.

The guide member(s), such as the first guide member, or at least a part thereof may thus extend parallel, such as substantially parallel with the rim or rim plane or with a faceplate attached to the rim. The antenna may accordingly provide a polarization of the electric field, which is not parallel with the rim plane normal. Thus the antenna may provide a polarization of the electric field which at least partly extends in a plane parallel with the rim, the rim plane or with a faceplate attached to the rim.

At least a part of the first guide member may extend along the inner surface substantially at an angle larger than 60 degrees and less than 120 degrees to the rim plane normal or larger than 75 degrees and less than 105 degrees to the rim plane normal.

The guide structure may comprise a second guide member extending along the inner surface of the shell body. Guide members of the guide structure may be distributed along the inner surface. For example, the first guide member and a second guide member may be arranged at an angle larger than 30 degrees, larger than 45 degrees, or at an angle in the range from 45 degrees to 180 degrees. The angle between guide members is the angle between a first axis and a second axis. The first axis is parallel to the rim plane and crossing the center axis and one of the guide members, and the second axis is parallel to the rim plane and crossing the center axis and the other of the guide members. Thus the first guide member and the second guide member may be arranged opposite each other on the inner surface.

The guide structure may extend parallel to a rim plane. The rim plane may be a plane of the rim, such as a plane extending across the rim defining the opening at the second end of the shell body. The guide structure may extend substantially parallel to the rim plane.

The first guide member may be a first recess in the inner surface. Thus the first guide member may have the shape of a first recess for guiding the antenna in the inner surface of the shell body. The first recess may guide the antenna by fixing, holding, attaching and/or fastening the antenna.

Other designs and implementations of the guide member(s) may be provided.

The shell body may comprise an inwardly extending portion near or at the second end, wherein the first guide member, e.g. in the form of a first recess, is formed in the inwardly extending portion. Thus the first recess may be arranged at the second end of the shell body. For example the first recess may be arranged in a first surface of the inwardly extending portion, which may be a flange, e.g. in order to reduce the risk of damaging the antenna during assembly of the hearing device. The first surface is the surface facing the first end of the shell body. The first recess may be arranged in a second surface of the inwardly extending portion, which may be a flange. The second surface is the surface facing the second end of the shell body.

A distance between the first recess and the second end may be at least 5 mm. The distance may be calculated or defined as a distance along a rim plane normal. It may be advantageous that there is some distance between the second end and the guide member or the first recess, because this provides for example that a part of the shell can be cut off at the second end without affecting or damaging the antenna, for example when assembling the hearing device for the user, in a case where the shell can be cut shorter or smaller.

The first recess may extend at a distance from the second end in a range between 5 mm to 20 mm. The range may be between 5 mm to 15 mm, or 5 mm to 10 mm, or 10 mm to 20 mm, or 10 to 15 mm. The distance may alternatively and/or additionally be calculated or defined as a distance from the rim plane or from a faceplate of the shell.

The first recess may be at least partly helical. Thus the first guide member or the first recess may extend at least partly along the inner surface in a turned or twisted manner, i.e. providing that the antenna may be guided in a helical manner in the shell body. Thus the first recess may extend in a turning manner between the first end and the second end.

The at least one guide member may include a second guide member in the inner surface. Thus both a first and a second guide member may be provided, and in such case the guide structure may not be a consecutive or interconnected structure, but separate guide members arranged with a distance to each other. Thus the guide structure may comprise a first and a second guide member. A number or plurality of guide members, such as two, three, four, five or more guide members, may be an advantage for guiding the antenna. For example the antenna may have a length and/or a flexibility which causes that the guidance or retention of the antenna is improved when the antenna is guided or retained in more locations by separate guide members.

The second guide member and the first guide member may be arranged with a distance to each other along an axis parallel to the rim plane and/or when projected onto the rim plane. Thus both the first and the second guide member may be arranged on the same axis being parallel to the rim plane. The first and the second guide member may be arranged opposite to each other, such as on opposing sides or faces of the inner surface of the shell body. The first and the second guide member may be arranged proximate to each other, such as within an angle of less than 45 degrees, as seen from the center axis. The first and the second guide member may be arranged such that the first guide member and the second guide member are arranged with the same or substantially the same (±5%) distance to the rim plane and to the second end.

The second guide member and the first guide member may be arranged with a distance therebetween along an axis perpendicular to the rim plane.

The second guide member may comprise or be a second recess. The second recess and the first recess may be arranged with a distance to each other along the axis perpendicular to the rim plane. Thus the first and the second recess may be arranged such that for example the first recess is closer to the second end than the second recess or vice versa.

The second guide member may be or comprise a second recess extending along the inner surface substantially at an angle larger than 45 degrees to the rim plane normal. The second recess and the first recess may be arranged with a distance to each other. The first recess and the second recess may be in the same plane parallel to the rim plane. The first and the second recess may be arranged for example opposite to each other, such as on opposing sides or faces of the inner surface of the shell body. Such arrangement may be provided in order to obtain a stable guiding and fixing of the antenna. The second guide member may extend along the inner surface substantially at an angle in a range between 45 degrees and 135 degrees to a rim plane normal.

A recess, such as the first recess and/or the second recess, may have a depth in a range from 0.1 mm to 2.0 mm. This depth may be advantageous when fitting the size of the antenna.

A recess, such as the first recess and/or the second recess, may have a width in a range from 0.1 mm to 2.0 mm. This width may be advantageous when fitting the size of the antenna.

A recess, such as the first recess and/or the second recess, may have a length larger than 2 mm, e.g. in order to provide sufficient support along the antenna.

The at least one guide member may comprise one or more sets of protrusions including a first set of protrusions extending along the inner surface. A set of protrusions may comprise one or more, such as one, two, three, four, or five protrusions etc.

The at least one guide member may comprise an inwardly extending part in the inner surface.

The shell body may comprise a contact surface or contact surfaces configured for attaching a faceplate to the shell. As an alternative to a faceplate, the contact surface may be configured for attaching a cover. The contact surface(s) may be a plane or flat surface at the opening of the rim at the second end of the shell body. Thus the contact surface(s) may correspond to where the rim plane contacts the material of the shell body. The faceplate may be attached to the contact surface(s) using e.g. an adhesive material like glue or tape, or by using mechanical fastening means, such as screws for fastening the faceplate to the contact surface of the shell body.

FIG. 1 schematically illustrates an example of a shell 2 for a hearing device. The shell 2 is shown in a cross-sectional side view. The shell 2 comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The opening 18 allows for insertion of hearing device components, such as receiver, microphone, antenna and processing unit in the shell. The shell 2 comprises a guide structure 20 on the inner surface 6 for guiding an antenna. The guide structure 20 comprises at least one guide member 22 including a first guide member 24 in the inner surface 6. The first guide member 24 comprises an inwardly extending portion 25 having a first recess 25A formed in a second surface of the inwardly extending portion 25. The inwardly extending portion 25 extends parallel or substantially parallel to the rim plan 14 along the inner surface 6. The first recess 25A is configured for at least partly accommodating an antenna (not shown). The first guide member 24 is arranged at a first distance of at least 2 mm from the second end 10.

Figure 2A:
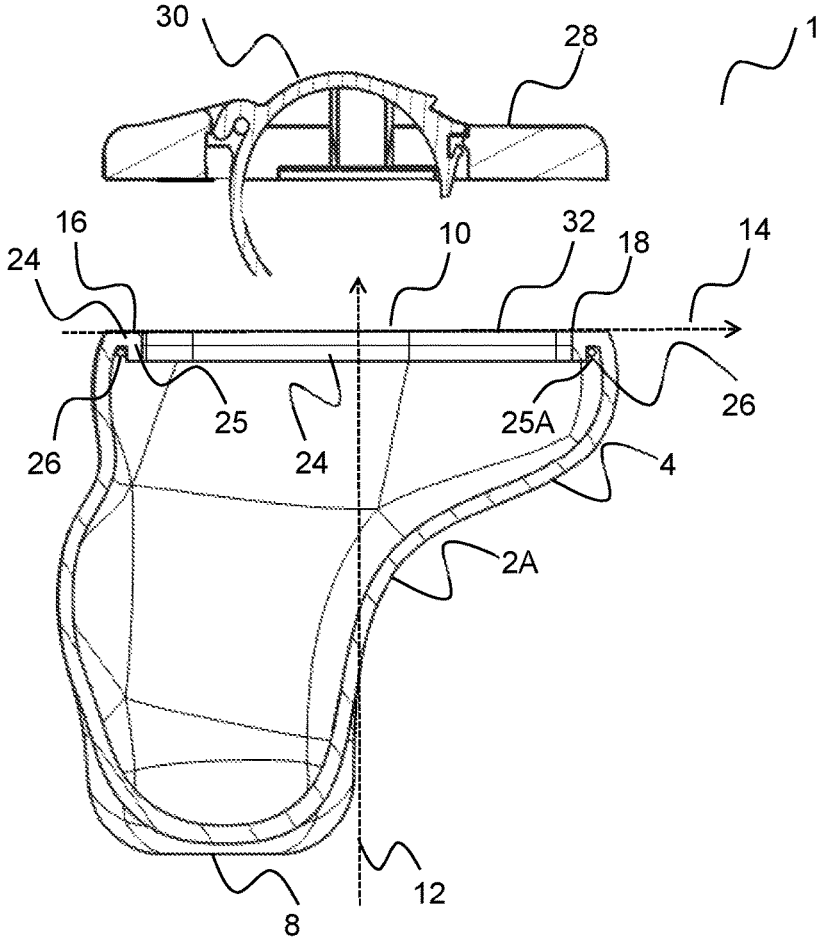
Figure 2B:
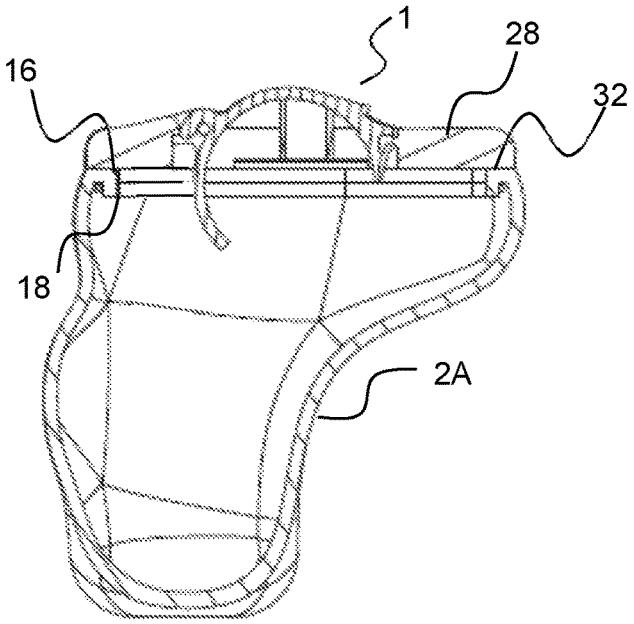

FIGS. 2*a* and 2*b* schematically illustrates a cross-sectional side view of an exemplary shell 2A for a hearing device 1. The shell 2A comprises a shell body 4 having an inner surface 6, the shell body 4 extending from a first end 8 to a second end 10 along an axis 12 perpendicular to a rim plane 14. The shell body 4 is configured for being at least partly positioned in the ear canal of a user and comprises a rim 16 defining an opening 18 at the second end 10. The shell 2A comprises a guide structure on the inner surface 6 for guiding an antenna 26. The guide structure 20 comprises at least one guide member including a first guide member 24 in the inner surface 6. The first guide member 24 is shaped like an inwardly extending portion 25 comprising a first recess 25A for guiding the antenna 26. The first recess 25A is formed in a first surface of the inwardly extending portion 25, the first surface facing the first end 8. The inwardly extending portion 25 extends parallel or substantially parallel to the rim plane 14 along the inner surface 6. The first guide member 24 is arranged at the second end 10. FIG. 2*a* also shows a faceplate 28 as part of the hearing device 1. The faceplate 28 is configured for being attached, such as glued, welded or otherwise fastened, to the rim 16 of the shell 2 for closing the opening 18 of the second end 10 of the shell 2. The faceplate may be attached at a contact surface 32 of the shell body configured for attaching the faceplate to the shell. An optional battery door 30 is shown in the faceplate 28. In FIG. 2*b*, the faceplate 28 has been attached to the shell 2 at the contact surface 32 of the rim 16 of the shell 2.

Figure 3A:
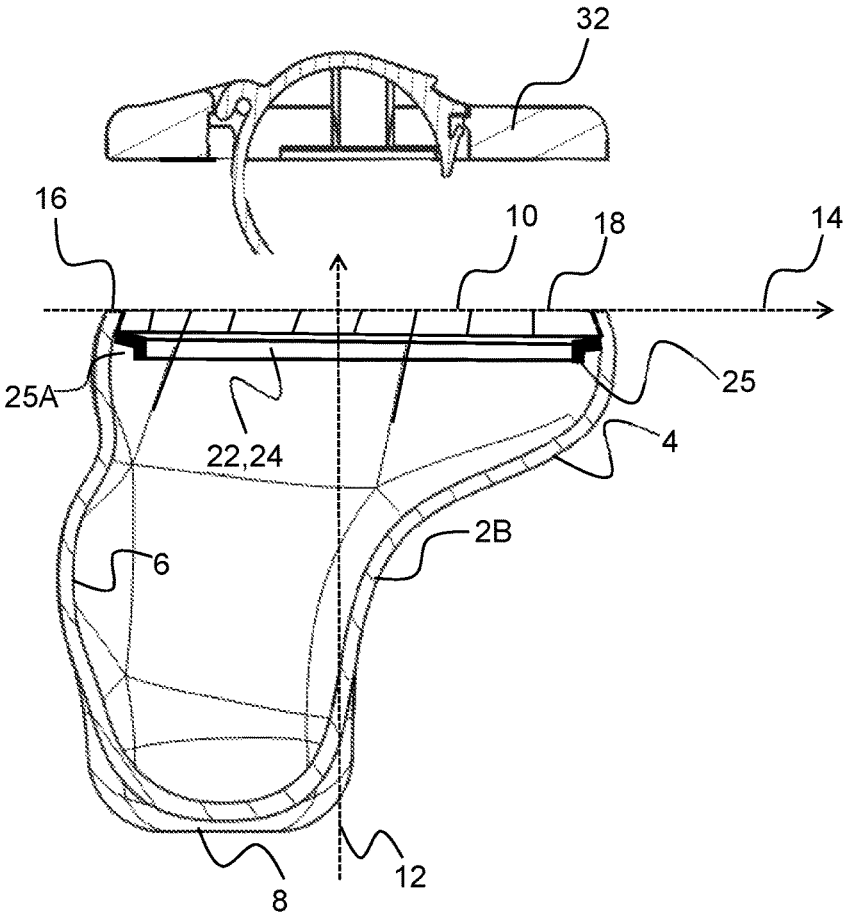

FIG. 3*a* schematically illustrates an example of a shell 2B for a hearing device. The shell 2B comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2B comprises a guide structure 20 on the inner surface 6 for guiding an antenna. The guide structure 20 comprises at least one guide member 22 including a first guide member 24. The first guide member 24 extends parallel to the rim plane and comprises an inwardly extending portion with a first recess 25A in the first surface facing the first end 8. The first guide member 24 is arranged at a distance of about 2 mm from the second end 10.

Figure 3B:
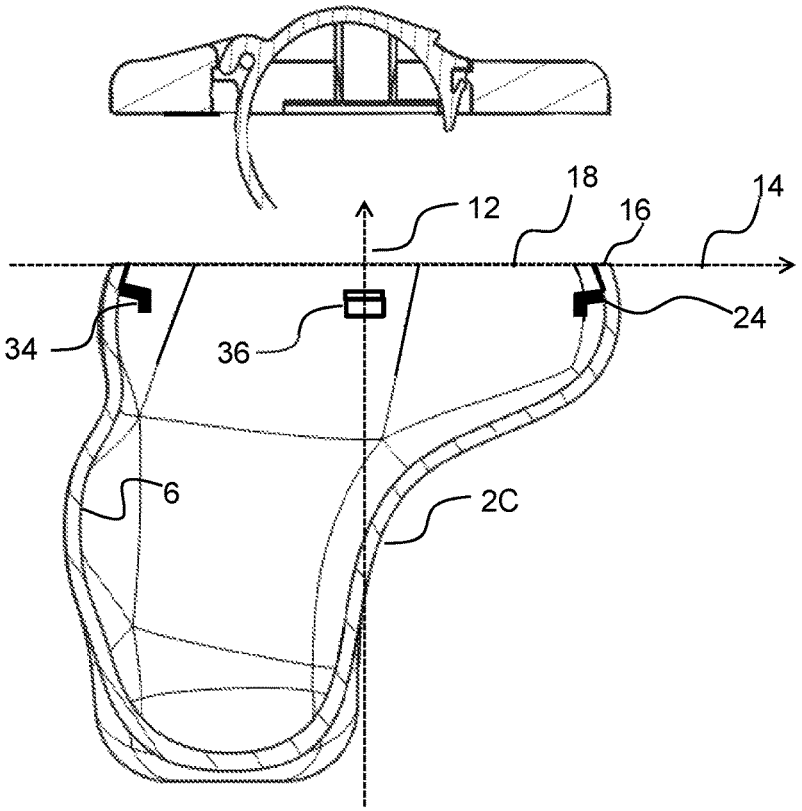

FIG. 3*b* schematically illustrates an example of a shell 2C for a hearing device. The shell 2C comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2C comprises a guide structure comprising four guide members including a first guide member 24, a second guide member 34, a third guide member 36, and a fourth guide member 38 (not shown in FIG. 3*b*) arranged in the inner surface 6 and distributed at angles of 90 degrees (see FIG. 3*c*). The guide members 24, 34, 36 and 38 are arranged in the same plane parallel to the rim plane 16 at a distance of about 2 mm from the second end 10. The guide members 24, 34, 36, 38 are L-shaped and forming respective recesses with lengths in the range from 1 mm to 10 mm.

Figure 3C:
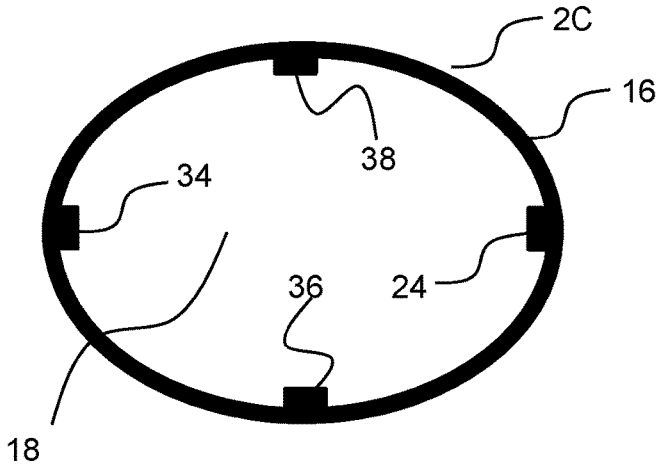

In FIG. 3*c*) the shell 2C is shown in a top view showing the first guide member 24, the second guide member 34, the third guide member 36 and a fourth guide member 38 distributed along the inner surface at angles of 90 degrees.

Figure 4:
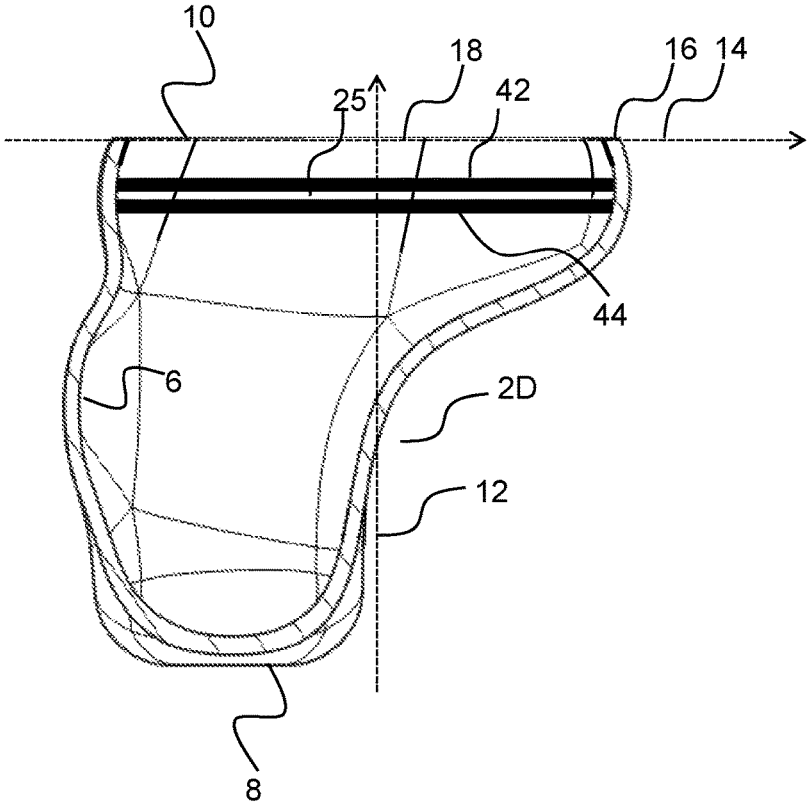

FIG. 4 schematically illustrates an example of a shell 2D for a hearing device. The shell 2 is shown in a cross-sectional side view. The shell 2D comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2D comprises a guide structure 20 on the inner surface 6 for guiding an antenna 26. The guide structure 20 comprises a first guide member 24 with a first recess 25 formed by a first set of protrusions 42, 44 extending along the inner surface 6 for guiding the antenna between the two protrusions 42, 44.

Figure 5:
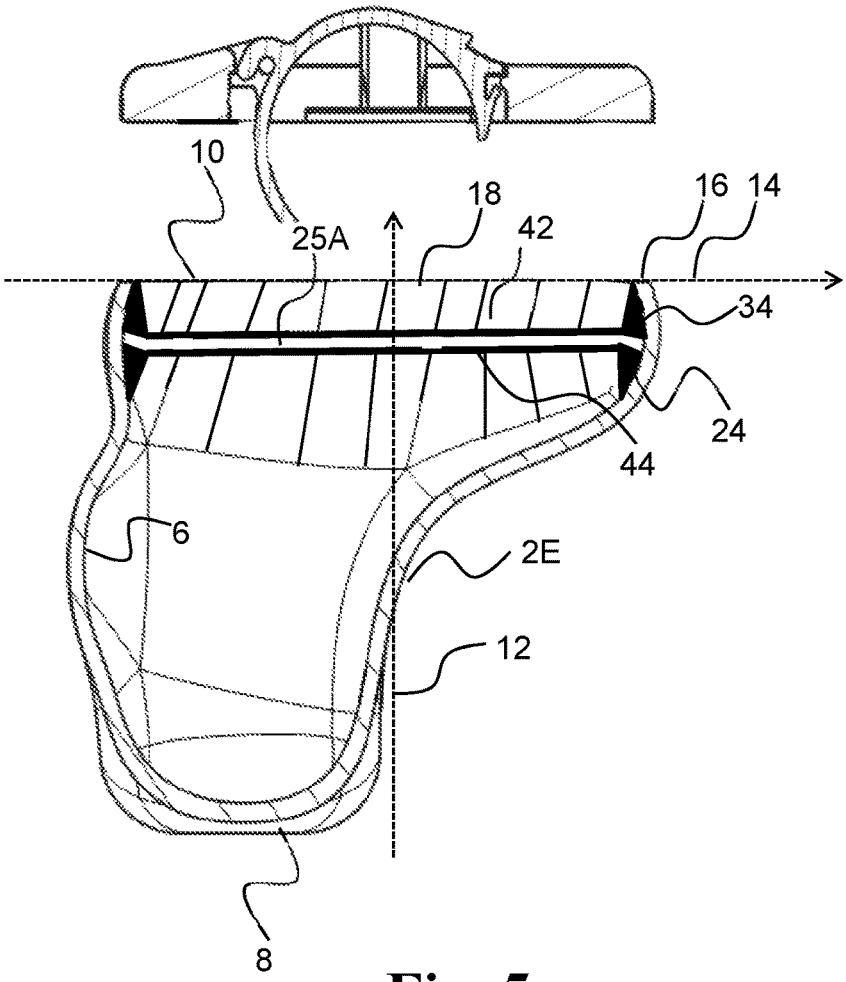

FIG. 5 schematically illustrates an example of a shell 2E for a hearing device. The shell 2E is shown in a cross-sectional side view. The shell 2E comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2E comprises a guide structure on the inner surface 6 for guiding an antenna 26. The guide structure 20 comprises at least one guide member including a first guide member 24 and a second guide member 34 extending along the inner surface 6 for guiding the antenna between the two guide members 24, 34.

Figure 6:
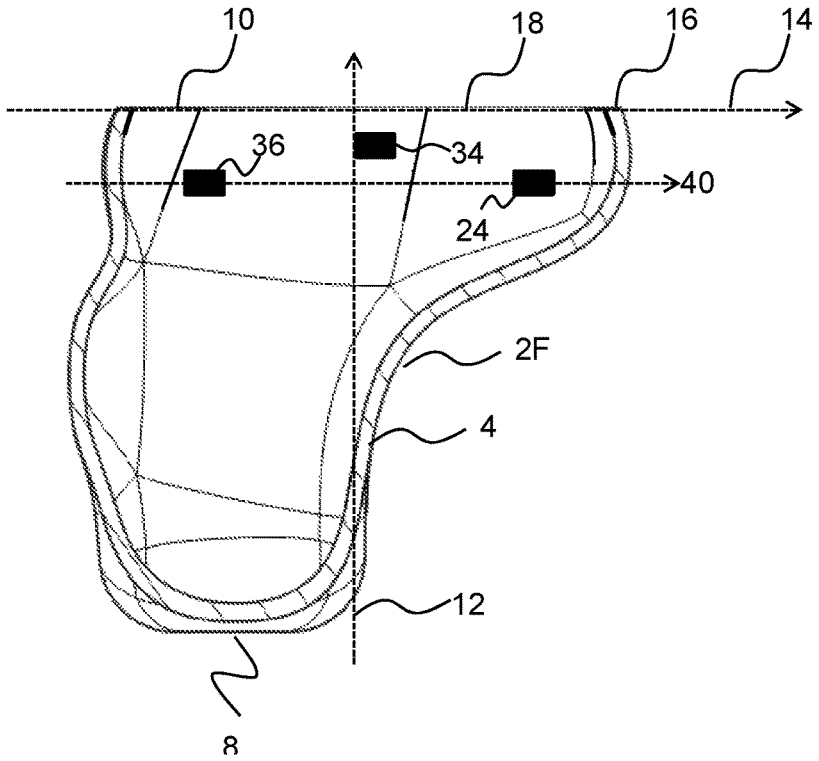

FIG. 6 schematically illustrates an example of a shell 2F for a hearing device. The shell 2F is shown in a cross-sectional side view. The shell 2F comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2F comprises a guide structure on the inner surface 6 for guiding an antenna. The guide structure comprises a first guide member 24, a second guide member 34 and a third guide member 36 extending along the inner surface 6 for guiding the antenna between the three guide members 24, 34, 36. The guide members 24, 34, 36 may be recesses. The second guide member 34 and the first guide member 24 are arranged with a distance to each other along the axis 12 perpendicular to the rim plane 14. The second guide member 34 and the third guide member 36 are also arranged with a distance to each other along the axis 12 perpendicular to the rim plane 14. The first guide member 24 and the third guide member 36 are arranged with a distance to each other along an axis 40 parallel to the rim plane 14. The antenna may be arranged such that the antenna is arranged between the first guide member 24 and the second end 10, then bending the antenna to be arranged between the second guide member 34 and the first end 8, and then bending the antenna again to be arranged between the third guide member 36 and the second end 10.

Figure 7:
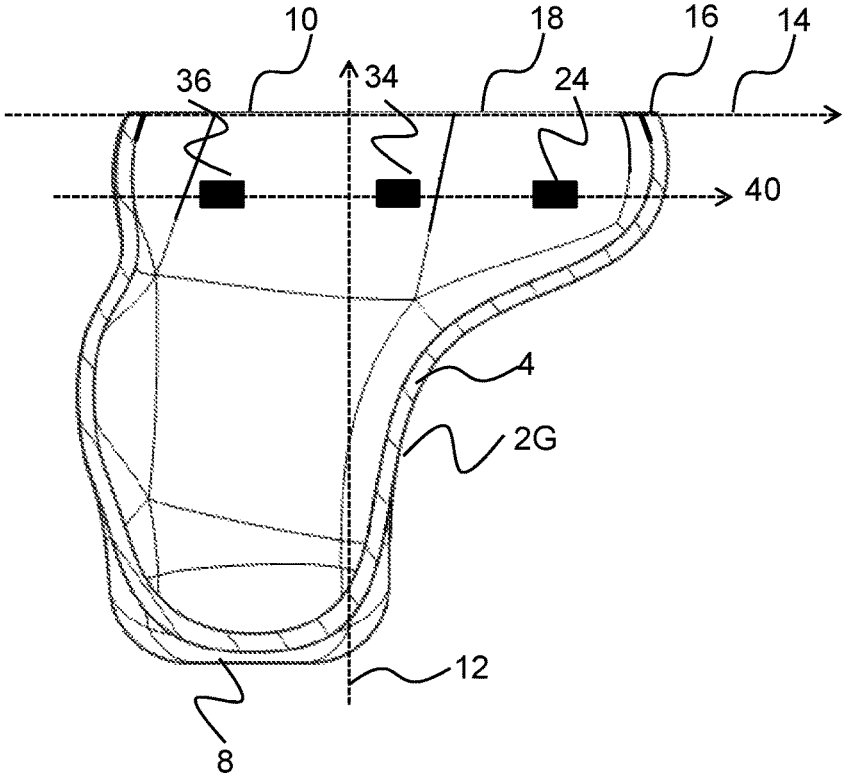

FIG. 7 schematically illustrates an example of a shell 2G for a hearing device. The shell 2G is shown in a cross-sectional side view. The shell 2G comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2 comprises a guide structure 20 on the inner surface 6 for guiding an antenna 26. The guide structure comprises at least one guide member including a first guide member 24 and a second guide member 34 and a third guide member 36 extending along the inner surface 6 for guiding the antenna between the three guide members 24, 34, 36. The guide members 24, 34, 36 may be or include recesses. The first 24, second 34 and third 36 guide members are arranged with a distance to each other along an axis 40 parallel to the rim plane 14. The antenna may be arranged such that the antenna is arranged between the first guide member 24 and the second end 10, then bending the antenna to be arranged between the second guide member 34 and the first end 8, and then bending the antenna again to be arranged between the third guide member 36 and the second end 10.

Figure 8:
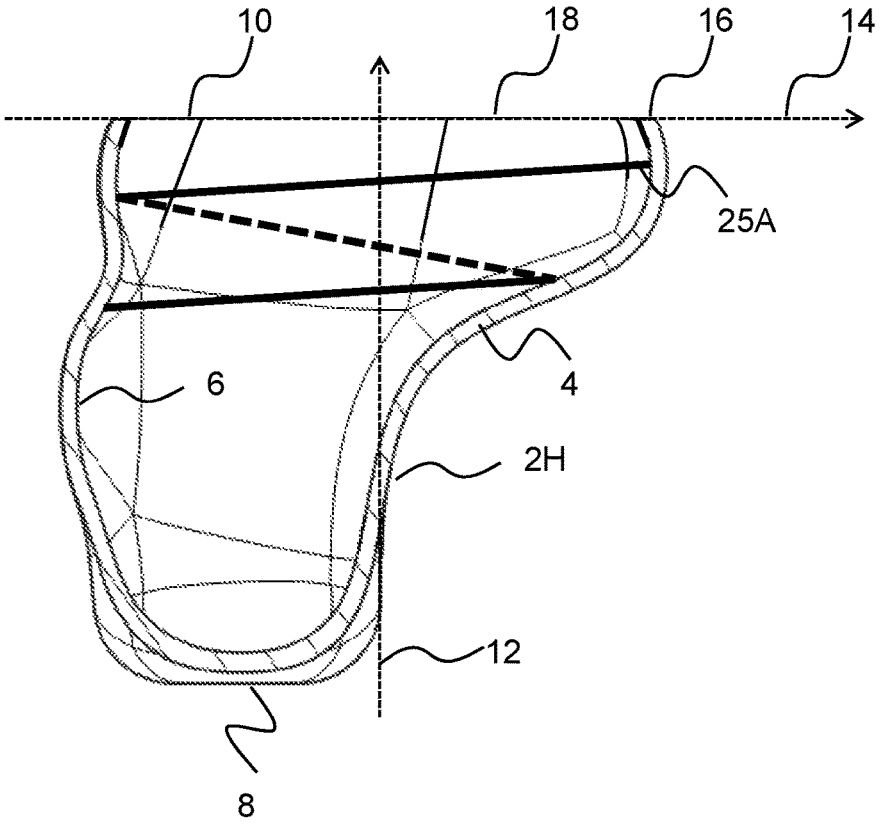

FIG. 8 schematically illustrates an example of a shell 2H for a hearing device. The shell 2H is shown in a cross-sectional side view. The shell 2H comprises a shell body 4 having an inner surface 6, the shell body 4 extending from a first end 8 to a second end 10 along an axis 12 perpendicular to a rim plane 14. The shell body 4 comprises a rim 16 defining an opening 18 at the second end 10. The shell 2 comprises a guide structure 20 on the inner surface 6 for guiding an antenna 26. The guide structure comprises a first guide member extending along the inner surface 6 for guiding the antenna. The first guide member is formed as an at least partly helical first recess 25 A.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1 hearing device
2, 2A, 2B, 2C, 2D, 2E, 2F, 2G, 2H shell
4 shell body
6 inner surface
8 first end
10 second end
12 axis perpendicular to rim plane, rim plane normal
14 rim plane
16 rim
18 opening
20 guide structure
22 at least one guide member
24 first guide member'
25 inwardly extending portion
25A first recess
26 antenna
28 faceplate
30 battery door
32 contact surface
34 second guide member
36 third guide member
38 fourth guide member
40 axis parallel to rim plane

The invention claimed is:

1. A shell for a hearing device, the shell comprising a shell body having an inner surface, the shell body defining a space for accommodating a receiver, the shell body having a first end and a second end, the shell body comprising a rim defining an opening at the second end, the rim defining a rim plane, the shell comprising a guide structure at the inner surface of the shell body, wherein the guide structure comprises a first guide member at the inner surface, wherein the guide structure defines at least a part of an antenna space for accommodating the antenna at an orientation that corresponds with the rim plane.

2. The shell according to claim 1, wherein the guide structure extends parallel to the rim plane.

3. The shell according to claim 1, wherein the first guide member comprises a part of the inner surface that defines a first recess.

4. The shell according to claim 3, wherein the shell body comprises an inwardly extending portion at the second end, wherein the first recess is formed at the inwardly extending portion.

5. The shell according to claim 3, wherein a distance between the first recess and the second end is at least 5 mm.

6. The shell according to claim 3, wherein the first recess is at least partly helical.

7. The shell according to claim 1, wherein the guide structure further includes a second guide member at the inner surface, wherein both the first guide member and the second guide member are located closer to the second end than the first end.

8. The shell according to claim 7, wherein the second guide member and the first guide member are arranged with a distance therebetween along an axis parallel to the rim plane.

9. The shell according to claim 7, wherein the first guide member defines a first recess, wherein the second guide member defines a second recess, and wherein the second recess and the first recess are arranged with a distance to each other along an axis perpendicular to the rim plane.

10. The shell according to claim 7, wherein the first guide member defines a first recess, wherein the second guide member defines a second recess extending along the inner surface at an angle larger than 45 degrees to the normal of the rim plane, and wherein the second recess and the first recess are arranged with a distance to each other.

11. The shell according to claim 1, wherein the first guide member comprises a first set of protrusions extending along the inner surface.

12. The shell according to claim 1, wherein the first guide member comprises an inwardly extending part of the inner surface.

13. The shell according to claim 1, wherein the shell body comprises a contact surface configured for attaching a faceplate to the shell.

14. A hearing device comprising the shell according to claim 1, wherein the hearing device comprises an antenna that is at least partially guided by the first guide member.

15. A method for manufacturing a shell for a hearing device, the method comprising:

forming a shell body having an inner surface and a guide structure at the inner surface, wherein the guide structure comprises a first guide member at the inner surface, the shell body defining a space for accommodating a receiver;

wherein the shell body has a first end and a second end, the shell body comprising a rim defining an opening at the second end, the rim defining a rim plane, wherein the guide structure defines at least a part of an antenna space for accommodating the antenna at an orientation that corresponds with the rim plane.

16. The hearing device of claim 14, wherein the antenna is flexible.

17. The shell of claim 1, wherein the inner surface is a part of a wall of the shell body, the wall extending circumferentially around the space defined by the shell body.

18. The shell of claim 1, wherein the first end is configured to face towards an eardrum when the first end of the shell body is placed in an ear canal.

19. The shell of claim 1, wherein the shell is configured for coupling with a faceplate.

20. The shell of claim 1, wherein the guide structure is located between the first end and the second end.

21. The shell of claim 1, wherein the guide structure defines the at least a part of the antenna space for accommodating the antenna at a parallel orientation with respect to the rim plane.

22. The shell of claim 1, wherein the guide structure defines the at least a part of the antenna space for accommodating the antenna at an angle that is anywhere between 60° and 120° with respect to the rim plane.

23. The method of claim 15, wherein the inner surface is a part of a wall of the shell body, the wall extending circumferentially around the space defined by the shell body.

24. The method of claim 15, wherein the first end is configured to face towards an eardrum when the first end of the shell body is placed in an ear canal.

25. The method of claim 15, wherein the shell is configured for coupling with a faceplate.

26. The method of claim 15, wherein the guide structure is located between the first end and the second end.

27. The method of claim 15, wherein the guide structure comprises a first guide member and a second guide member, and wherein both the first guide member and the second guide member are located closer to the second end than the first end.

28. The method of claim 15, wherein the guide structure defines the at least a part of the antenna space for accommodating the antenna at a parallel orientation with respect to the rim plane.

29. The method of claim 15, wherein the guide structure defines the at least a part of the antenna space for accommodating the antenna at an angle that is anywhere between 60° and 120° with respect to a normal of the rim plane.

* * * * *